US009962967B2

(12) United States Patent
Kanada et al.

(10) Patent No.: US 9,962,967 B2
(45) Date of Patent: May 8, 2018

(54) RECORDING DEVICE, TAKE-UP DEVICE, AND METHOD FOR TAKING UP RECODING MEDIUM

(71) Applicant: SEIKO EPSON CORPORATION, Tokyo (JP)

(72) Inventors: Hidemasa Kanada, Nagano (JP); Masato Mitsuhashi, Nagano (JP); Koji Higuchi, Nagano (JP); Toshimitsu Hirai, Yamanashi (JP); Mitsuhiro Isobe, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/168,354

(22) Filed: May 31, 2016

(65) Prior Publication Data

US 2016/0271976 A1 Sep. 22, 2016

Related U.S. Application Data

(63) Continuation of application No. 14/140,100, filed on Dec. 24, 2013, now Pat. No. 9,359,162.

(30) Foreign Application Priority Data

Dec. 25, 2012 (JP) ..... 2012-281200
Sep. 6, 2013 (JP) ..... 2013-184750

(51) Int. Cl.
*B41J 15/04* (2006.01)
*B65H 19/22* (2006.01)
(Continued)

(52) U.S. Cl.
CPC ..... *B41J 15/04* (2013.01); *B41J 3/4078* (2013.01); *B41J 13/0009* (2013.01); *B41J 15/02* (2013.01);
(Continued)

(58) Field of Classification Search
CPC ..... B41J 15/04; B41J 13/0009; B41J 25/001; B41J 15/02; B41J 15/165; B41J 3/4078;
(Continued)

(56) References Cited

U.S. PATENT DOCUMENTS 601,495 A 3/1898 Cornell et al.
4,033,521 A 7/1977 Dee
(Continued)

FOREIGN PATENT DOCUMENTS

DE 19929317 A1 12/2000
EP 010172 A2 12/1997
(Continued)

OTHER PUBLICATIONS

The Extended European Search Report for the corresponding European Application No. 13198746.3 dated Apr. 24, 2014.

*Primary Examiner* — Justin Seo

(57) ABSTRACT

A recording device includes a conveyance mechanism, a recording mechanism, a rotational mechanism of a plurality of take-up spindles, and a control unit. The conveyance mechanism is configured to convey a recording medium intermittently in a conveyance direction. The recording mechanism is configured to record by reciprocatingly scanning a recording head in a direction that intersects with the conveyance direction. The rotational mechanism is configured to take up the recording medium. The control unit is configured to control the conveyance mechanism and the rotational mechanism to substantially synchronize conveying of the recording medium by the conveyance mechanism and taking-up of the recording medium by the rotational mechanism.

5 Claims, 13 Drawing Sheets

(51) Int. Cl.

| | |
|---|---|
| ***B41J 3/407*** | (2006.01) |
| ***B41J 15/16*** | (2006.01) |
| ***B41J 13/00*** | (2006.01) |
| ***B41J 15/02*** | (2006.01) |
| ***B41J 25/00*** | (2006.01) |

(52) U.S. Cl.
CPC ..... *B41J 15/048* (2013.01); *B41J 15/165* (2013.01); *B41J 25/001* (2013.01); *B65H 19/2215* (2013.01); *B65H 2301/46011* (2013.01); *B65H 2404/20* (2013.01); *B65H 2404/62* (2013.01); *B65H 2408/23152* (2013.01); *B65H 2515/31* (2013.01); *B65H 2801/36* (2013.01)

(58) Field of Classification Search
CPC ..... B41J 15/048; B65H 19/2215; B65H 2515/31; B65H 2801/36; B65H 2408/23152; B65H 2404/62; B65H 2404/20; B65H 2301/46011
See application file for complete search history.

(56) References Cited

U.S. PATENT DOCUMENTS

| | | | | |
|---|---|---|---|---|
| 4,171,780 | A | 10/1979 | Bugnone | |
| 5,810,966 | A | 9/1998 | Semba | |
| 6,068,374 | A | 5/2000 | Kurata et al. | |
| 8,235,091 | B2 * | 8/2012 | Ozaki ..... | B21C 47/04 164/423 |
| 2009/0244138 | A1 | 10/2009 | Konno | |
| 2012/0075373 | A1 | 3/2012 | Ito | |

FOREIGN PATENT DOCUMENTS

| | | | |
|---|---|---|---|
| JP | 59-026460 | U | 2/1984 |
| JP | 11-115166 | A | 4/1999 |
| JP | 2004-066588 | A | 3/2004 |
| JP | 2007-196625 | A | 8/2007 |
| JP | 2010-036990 | A | 2/2010 |
| JP | 2011-031418 | A | 2/2011 |

* cited by examiner

RECORDING DEVICE, TAKE-UP DEVICE, AND METHOD FOR TAKING UP RECODING MEDIUM

CROSS-REFERENCE TO RELATED APPLICATIONS

This application is a continuation application of U.S. patent application Ser. No. 14/140,100, filed on Dec. 24, 2013. This application claims priority to Japanese Patent Application No. 2012-281200 filed on Dec. 25, 2012 and Japanese Patent Application No. 2013-184750 filed on Sep. 6, 2013. The entire disclosures of U.S. patent application Ser. No. 14/140,100 and Japanese Patent Application Nos. 2012-281200 and 2013-184750 are hereby incorporated herein by reference.

BACKGROUND

Technical Field

The present invention relates to a recording device, a take-up device, and a method for taking up a recording medium.

Background Technology

Recording devices for recording onto a roll-type recording medium have been used. In a case where such a recording device is used to record an image onto a roll-type recording medium, then in some instances recording media onto which recordings have been made need to be taken up individually and separately in accordance with the type of recorded image or the like. Every single instance where the recording of one type of image is concluded, however, necessitates effort and time to interrupt the recording operation, remove the roll of recording medium on which a recording has been made and which has been taken up from the recording device, and thereafter load a paper core or the like for forming a new roll into the recording device. For this reason, for example, Patent Document 1 discloses a recording device provided with a turret to which are provided a plurality of take-up spindles for taking up recording media. The recording device disclosed in Patent Document 1 makes it possible to individually, separately take up recording media on which recordings have been made about respective take-up spindles without having to interrupt the recording operation. Recording devices that record by reciprocatingly scanning a recording head in a direction that intersects with a direction of conveyance of a recording medium have also often been used.

Japanese Laid-open Patent Publication No. 11-115166 (Patent Document 1) is an example of the related art.

SUMMARY

Problems to be Solved by the Invention

However, the recording device of Patent Document 1 adopts a configuration that is provided with a take-up section for taking up the recording media by using a take-up spindle that rotates at a predetermined speed. Herein, when this take-up section is applied to a recording device that records by reciprocatingly scanning a recording head in a direction that intersects with a direction of conveyance of a recording medium, then the conveyance of the recording medium during the recording becomes an intermittent conveyance, whereas the rotation of the take-up spindle while the recording medium is being taken up will be a continuous rotation. That is to say, the movement of the recording medium in the take-up section and in a region for recording onto the recording medium by a recording head is discontinuous, and in some instances, for example, the recording medium can vibrate during the recording along with the recording head for conveying the recording medium, and the image quality of the recorded image is thus diminished. Furthermore, in a case where the rotation of the turret is also a continuous rotation, then the discontinuity of the movement of the recording medium in the recording region and the take-up section is prominent, and in some instances the decline in image quality of the recorded image can also be prominent.

In view whereof, a purpose of the invention is to minimize any decline in image quality of a recorded image in a recording device that is provided with a turret to which a plurality of take-up spindles for taking up a recording medium are provided and that records by reciprocatingly scanning a recording head.

Means Used to Solve the Above-Mentioned Problems

According to an aspect of the invention, a recording device includes a conveyance mechanism, a recording mechanism, a rotational mechanism of a plurality of take-up spindles, and a control unit. The conveyance mechanism is configured to convey a recording medium intermittently in a conveyance direction. The recording mechanism is configured to record by reciprocatingly scanning a recording head in a direction that intersects with the conveyance direction. The rotational mechanism is configured to take up the recording medium. The control unit is configured to control the conveyance mechanism and the rotational mechanism to substantially synchronize conveying of the recording medium by the conveyance mechanism and taking-up of the recording medium by the rotational mechanism.

According to the aspect of the invention, the control unit is configured to control the recording mechanism to synchronize reciprocatingly scanning of the recording head with the conveying of the recording medium and the taking-up of the recording medium.

According to the aspect of the invention, the recording device further includes a feeding-out mechanism configured to feed out the recording medium to the conveyance mechanism, and the control unit is configured to control the feeding-out mechanism to synchronize feeding out of the recording medium with the conveying of the recording medium and the taking-up of the recording medium.

According to the aspect of the invention, the recording device further includes a feeding-out mechanism configured to feed out the recording medium to the conveyance mechanism, and the control unit is configured to control the feeding-out mechanism to synchronize feeding out of the recording medium with the conveying of the recording medium, the taking-up of the recording medium, and the reciprocatingly scanning of the recording head.

According to the aspect of the invention, the recording device further includes a turret to which the take-up spindles are rotatably coupled.

BRIEF DESCRIPTION OF THE DRAWINGS

Referring now to the attached drawings which form a part of this original disclosure.

DETAILED DESCRIPTION OF EXEMPLARY EMBODIMENTS

[Embodiment 1] (FIGS. 1 to 6 and 9)

Figure 1:
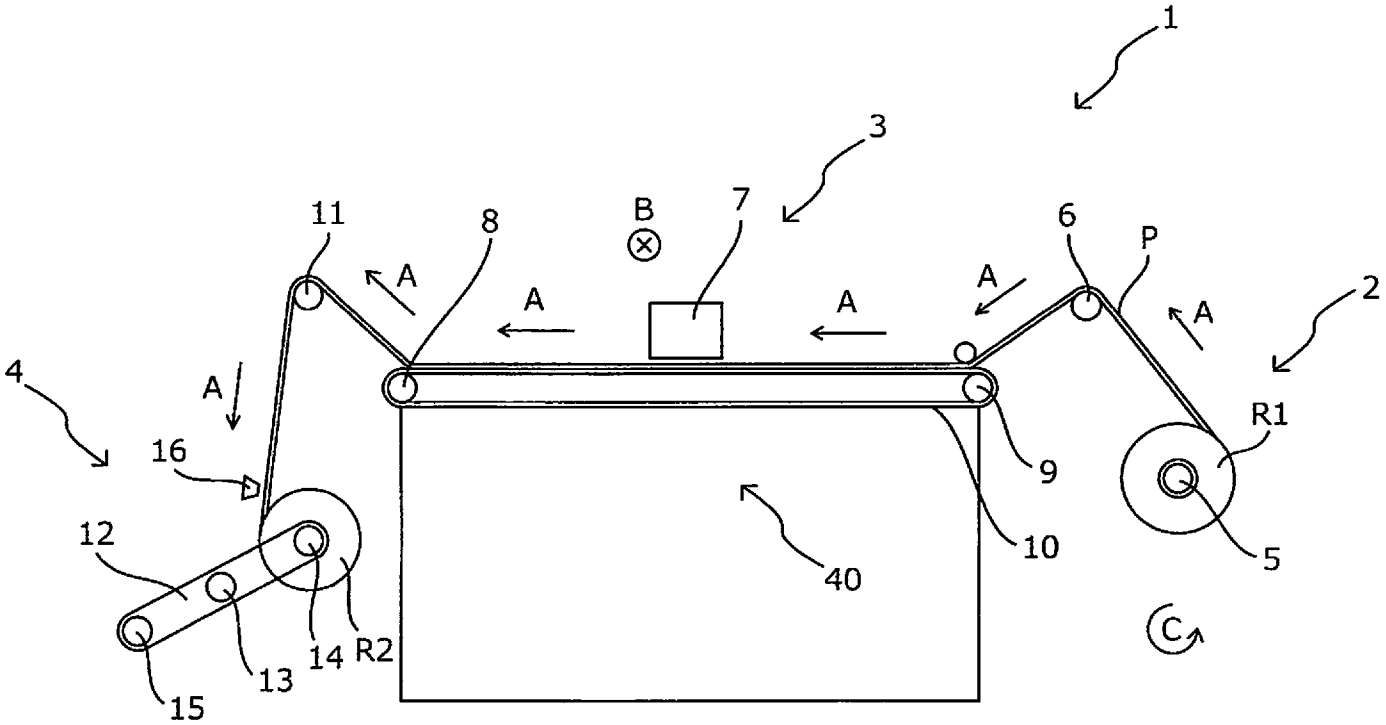
FIG. 1 is a schematic side view representing a recording device as in an embodiment 1 of the invention.

Recording devices as in embodiments of the invention shall be described in greater detail below, with reference to the accompanying drawings. The first to be described shall be a recording device as in an embodiment 1 of the invention. FIG. 1 represents a schematic perspective view of a recording device 1 as in the embodiment 1 of the invention.

The recording device 1 of the present embodiment is provided with a set section 2 by which a roll R1 of a recording medium P for carrying out recording can be fed out. The recording device 1 is also provided with a conveyance mechanism 40 for conveying a roll of the recording medium P in a direction of conveyance A. The recording device 1 is further provided with a recording mechanism for recording by reciprocatingly scanning a recording head 7 in a direction of scanning B that intersects with the direction of conveyance A of the recording medium P. The recording device 1 is additionally provided with a take-up mechanism 4 including a turret 12 to which take-up spindles 14, 15 for taking up the recording medium P are provided and which is able to rotate in a direction of rotation C about a rotating shaft 13, and a cutter 16 that serves as a cutting section for cutting the recording medium P that has been taken up.

The set section 2 is provided with a rotating shaft 5 that also serves as a set position for the roll R1 of the recording medium P for carrying out recording, and is configured so that the recording medium P can be fed out to the conveyance mechanism 40 via a driven roller 6 from the roll R1 that has been set onto the rotating shaft 5. When the recording medium P is being fed out to the conveyance mechanism 40, the rotating shaft 5 rotates in the direction of rotation C.

The conveyance mechanism 40 is provided with: a glue belt 10 for conveying the recording medium P borne thereon, having been fed out from the set section 2; and a conveyance roller 8 and driven roller 9 for moving the glue belt 10. When the recording medium P is being conveyed, the conveyance roller 8 rotates in the direction of rotation C.

The recording mechanism 3 includes the recording head 7, a carriage 41 (see FIG. 9) onto which the recording head 7 is loaded, and a carriage motor 26 (see FIG. 2) for reciprocatingly moving the carriage in the direction of scanning B. In FIG. 1, the direction of scanning B is the direction perpendicular to the plane of the paper. During recording, recording is carried out by reciprocatingly scanning the recording head 7, but amidst the recording scanning (amidst the movement of the recording head), the conveyance mechanism 40 discontinues the conveyance of the recording medium P. Expressed differently, recording includes alternating between reciprocating scanning of the recording head 7 and conveyance of the recording medium P. That is to say, during recording, the conveyance mechanism 40 intermittently conveys the recording medium P so as to correspond with the reciprocating scanning of the recording head 7.

The take-up mechanism 4 is a mechanism for taking up the recording medium P that, having been subjected to recording, has been conveyed from the conveyance mechanism 40 via a driven roller 11; a paper core for take-up or the like is set onto the take-up spindles 14, 15 provided to the turret 12, and the recording medium P is wound therearound, this making it possible for the recording medium P to be taken up as a roll R2 of the recording medium P. The recording device 1 of the present embodiment is provided with a turret to which two of the take-up spindles are provided, but the configuration can also be one provided with a turret to which three or more of the take-up spindles are provided.

The take-up mechanism 4 of the present embodiment causes the take-up spindles 14, 15 and/or the turret 12 to rotate intermittently so as to correspond to the intermittent conveyance of the recording medium P during recording. Because the intermittent conveyance of the recording medium P corresponds to the reciprocating scanning of the recording head 7, when expressed differently, the take-up spindles 14, 15 and/or the turret 12 are intermittently rotated so as to correspond to the reciprocating scanning of the recording head 7. For this reason, the force of when the recording medium P is being detached away from the glue belt 10 can be minimized, thus making it possible to minimize the vibration of the recording medium and to minimize any decline in the image quality of the recorded image.

Figure 2:
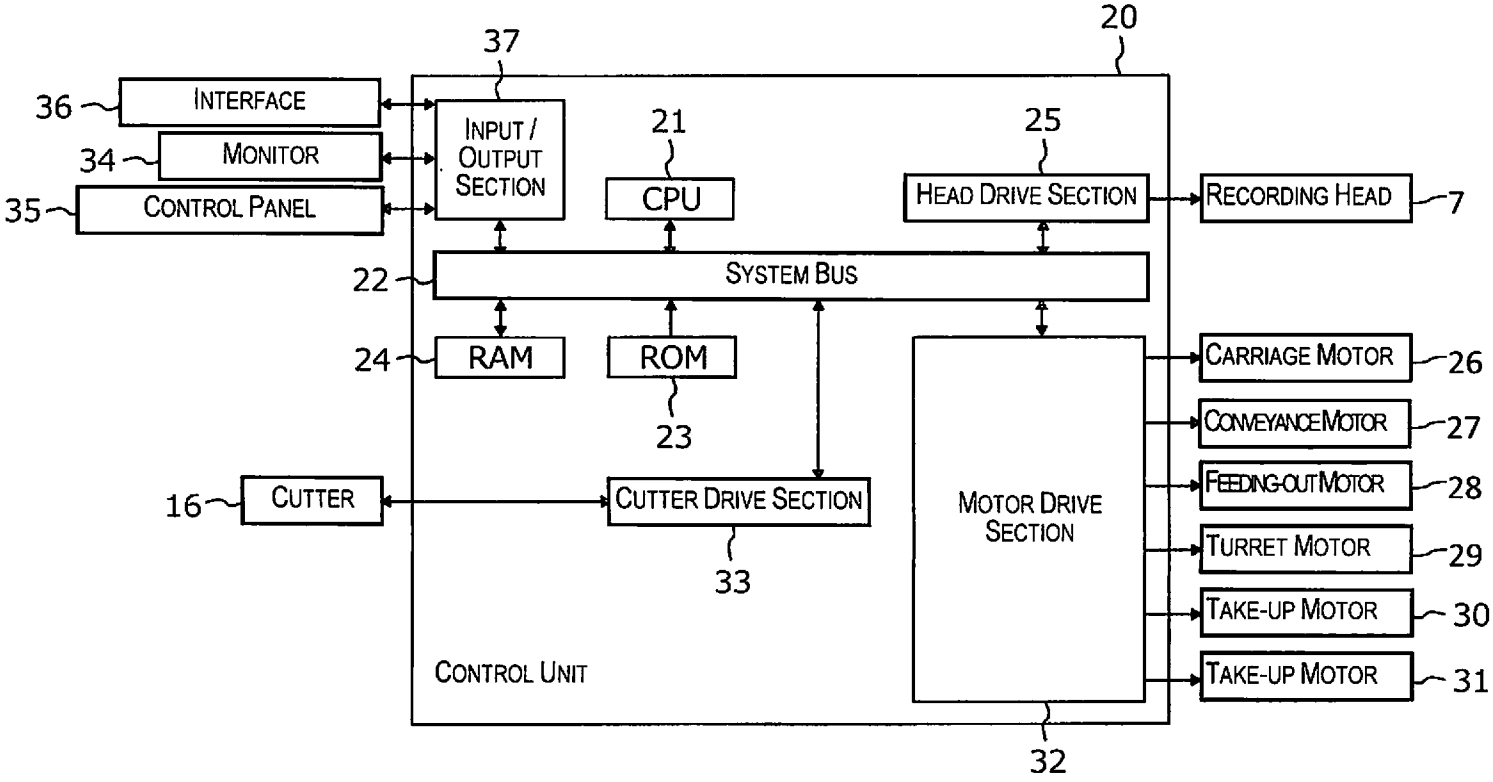
FIG. 2 is a block diagram of the recording device as in the embodiment 1 of the invention.

The electrical configuration in the recording device 1 of the present embodiment shall be described next. FIG. 2 is a block diagram of the recording device 1 of the present embodiment. A CPU 21 that governs the control of the entirety of the recording device 1 is provided to a control unit 20. The CPU 21 is connected over a system bus 22 to a ROM 23 that stores a variety of control programs executed by the CPU 21 and the like, and to a RAM 24 in which data can be temporarily stored. The CPU 21 is also connected over the system bus 22 to a head drive section 25 for driving the recording head 7.

The CPU 21 is further connected over the system bus 22 to a motor drive section 32 for causing driving by the carriage motor 26, a conveyance motor 27, an feeding-out motor 28, a turret motor 29, and take-up motors 30, 31. Herein, the carriage motor 26 is a motor for moving the carriage 41 onto which the recording head 7 has been loaded. The conveyance motor 27 is a motor for driving the conveyance roller 8. The feeding-out motor 28 is a rotational mechanism of the rotating shaft 5, and is a motor for driving the rotating shaft 5 in order for the recording medium P to be fed out to the conveyance mechanism 40. The turret motor 29 is a rotational mechanism of the turret 12, and is a drive motor for causing the turret 12 to rotate when the take-up spindle that is being used to take up the recording medium P is being changed from one to the other. The take-up motors 30, 31 are rotational mechanisms of the take-up spindles 14, 15, respectively, and are drive motors for causing the take-up spindles 14, 15 to rotate.

The CPU 21 is further connected over the system bus 22 to a cutter drive section 33 for driving the cutter 16 so as to cut the recording medium P when the take-up spindle that is being used to take up the recording medium P is being replaced with the other take-up spindle. The CPU 21 is additionally connected to an input/output section 37 for sending and receiving data and signals to and from a monitor 34 and control panel 35 that are provided to the recording device 1, and to and from an interface 36 for, inter alia, inputting recording data or the like from an external device such as a PC.

The control unit 20 during recording controls the conveyance mechanism 40 so as to cause the recording medium P to be intermittently conveyed by intermittently moving the glue belt 10, and also controls the take-up motors 30, 31 and the turret motor 29 so as to cause the take-up spindles 14, 15 and/or the turret 12 to rotate intermittently, so as to correspond to the reciprocating scanning of the recording head 7 The control unit 20 also controls the feeding-out motor 28 so as to cause the rotating shaft 5 of the set section 2 to rotate intermittently so as to correspond to the reciprocating scanning of the recording head 7. The performance of the controls of such description by the control unit 20 causes the movement of the recording medium P to be synchronized between a section where the recording medium P is fed out, a region for recording by the recording head 7, and the section where the recording medium P is taken up (the take-up spindles 14, 15) in the recording device 1 of the present embodiment. In this manner, any vibration during conveyance of the recording medium P is minimized, and any decline in the image quality of the recorded image is minimized.

The control unit 20 also controls the take-up motors 30, 31 so as to discontinue the rotation of the take-up spindles 14, 15 when the turret 12 is being intermittently rotated, during such times as when the take-up spindle that is being used to take up the recording medium P is replaced with the other take-up spindle. Having the control unit 20 be of a configuration for carrying out the controls of such description creates a simple configuration where there is no need to carry out complex computations. The configuration can also be one where the take-up motors 30, 31 and the turret motor 29 are controlled so that when the turret 12 is being intermittently rotated, the take-up spindles 14, 15 are also rotated at the same time.

Figure 3:
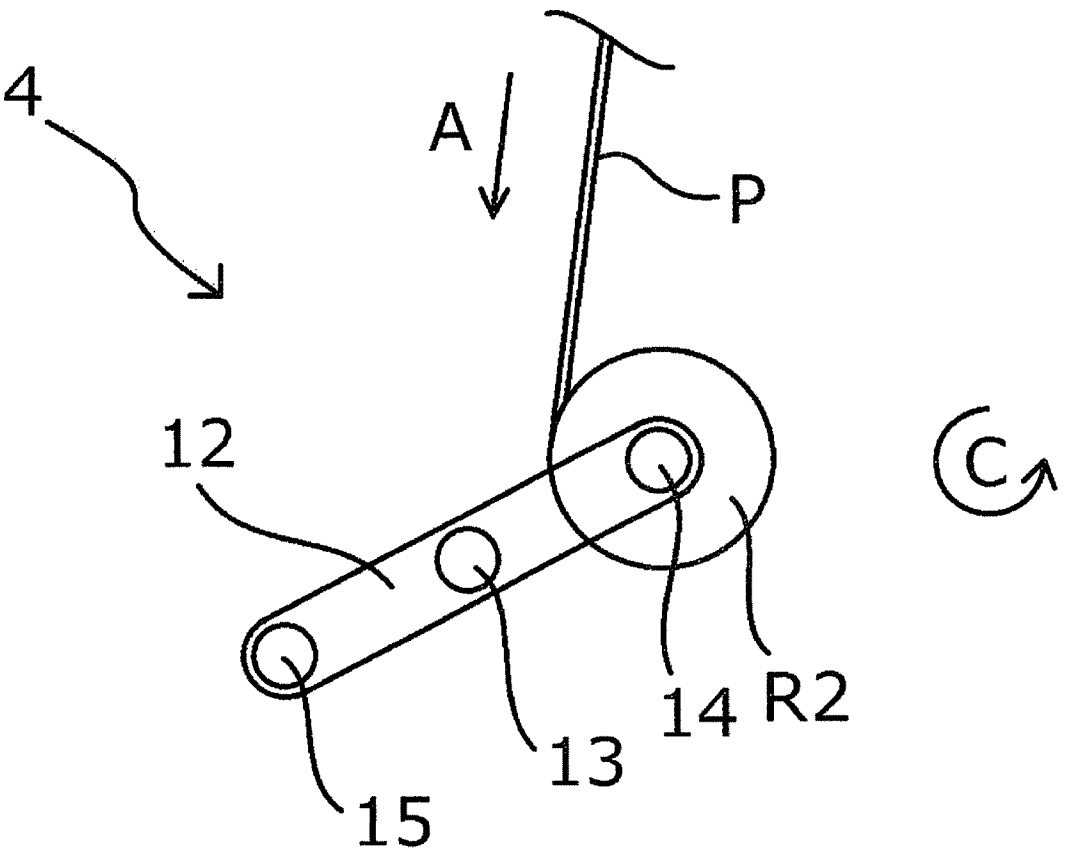
FIG. 3 is a schematic view representing a take-up position of a recording medium in a turret of the recording device as in the embodiment 1 of the invention.

Described next are the take-up position of the recording medium P in the turret 12 of the recording device 1 of the present embodiment, and a rotational operation of the turret 12 for when the take-up spindle that is being used to take up the recording medium P is replaced with the other take-up spindle. FIG. 3 is a schematic view representing the take-up position of the recording medium P in the turret 12 of the recording device 1 of the present embodiment. As is represented in FIG. 3, the take-up position of the recording medium P in the take-up spindle 14 being used for when the recording medium P is being taken up will be further on the upstream side in the direction of conveyance A than the take-up spindle 15.

Figure 4:
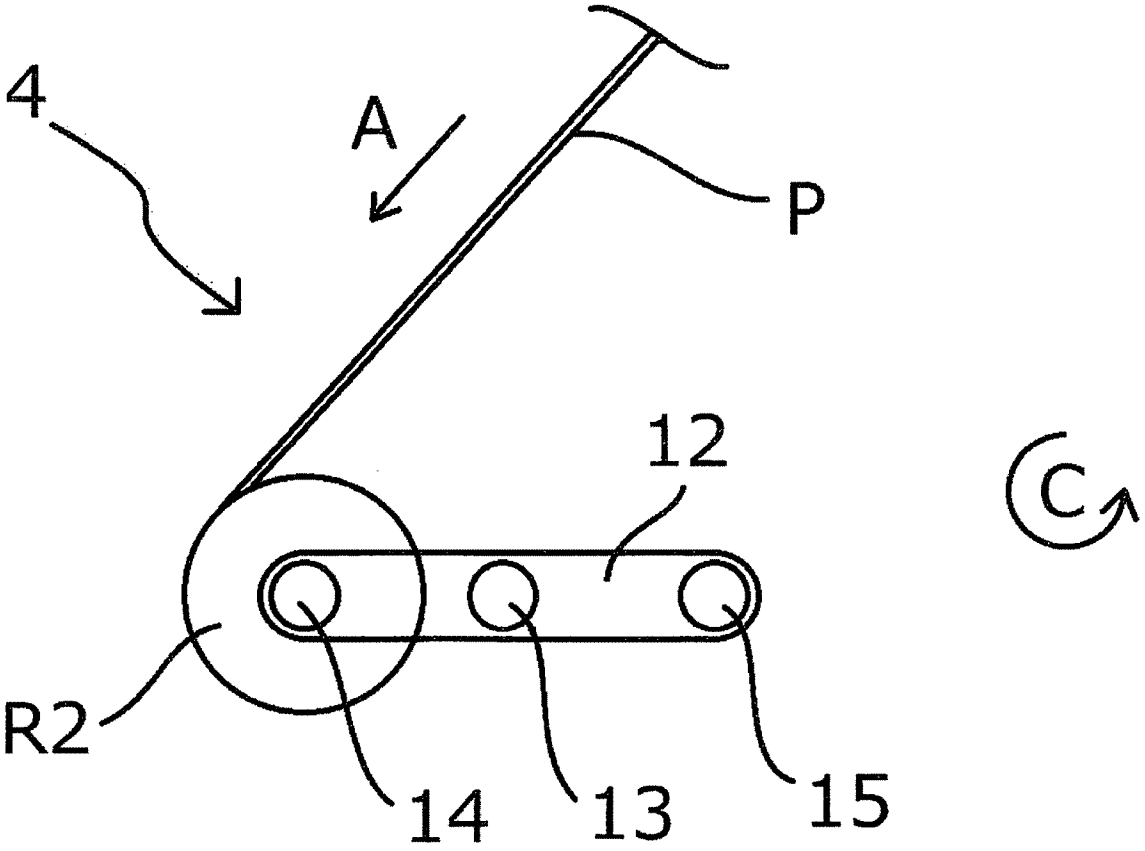
FIG. 4 is a schematic view representing a position during a rotational operation of the turret of the recording device as in the embodiment 1 of the invention.
Figure 5:
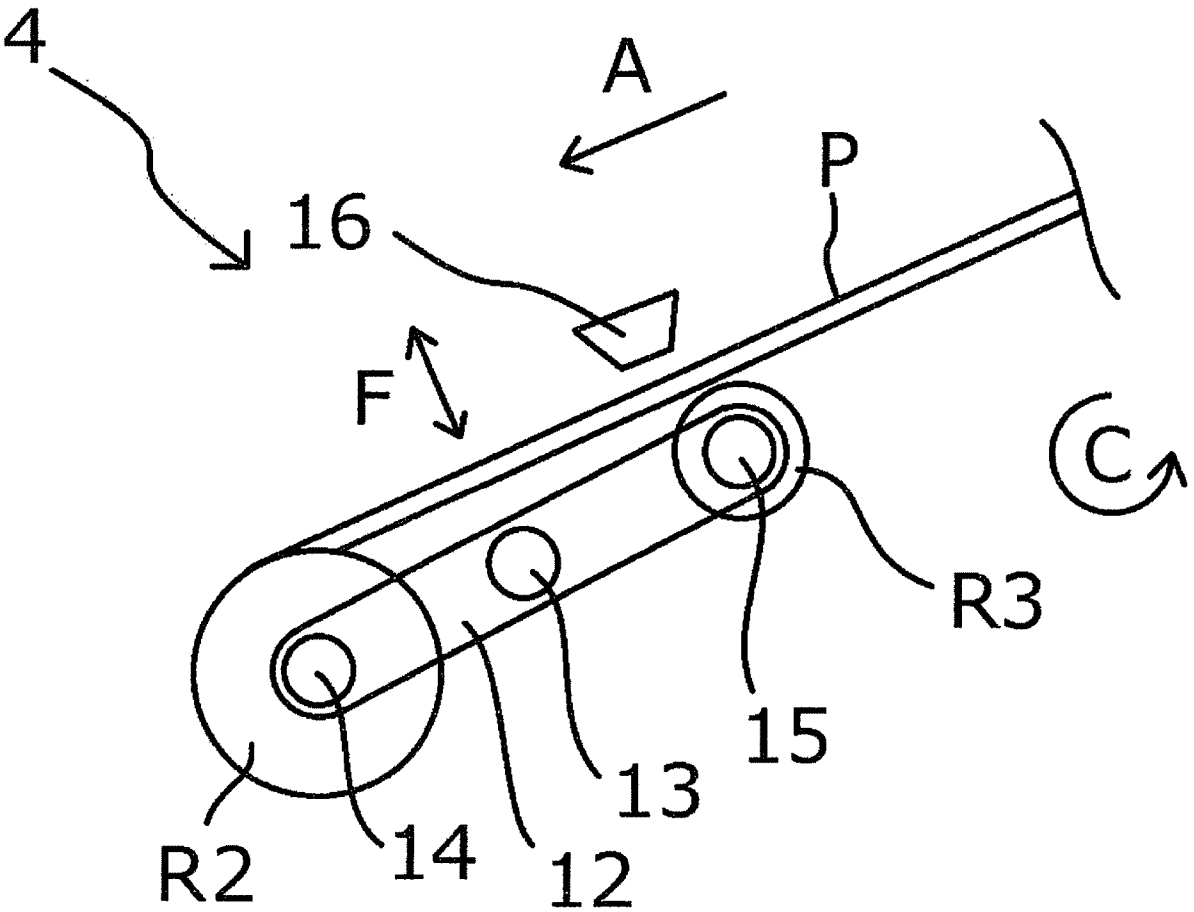
FIG. 5 is a schematic view representing a state before a cutting where the rotational operation of the turret of the recording device as in the embodiment 1 of the invention has been concluded and the recording medium is cut.

FIG. 4 is a schematic view representing a position during a rotational operation of the turret 12 of the recording device 1 of the present embodiment. FIG. 5 is a schematic view representing a state before a cutting where the rotational operation of the turret 12 of the recording device 1 of the present embodiment has been concluded and the recording medium P is cut. As is represented in FIGS. 3, 4, and 5, the turret 12 is rotated by 180° in the direction of rotation C when the take-up spindle 14 that is being used to take up the recording medium P is replaced with the other take-up spindle 15. Because the rotational operation of the turret 12 is carried out during recording, the rotation of the turret 12 is an intermittent rotation due to the control of the control unit 20.

Due to the configuration of such description, in the recording device 1 of the present embodiment, the position of the take-up spindle 14 at the time when the take-up of the recording medium P (the roll R2 in FIG. 5) has already been concluded is positioned further on the upstream side in the direction of conveyance A than the take-up spindle 15. For this reason, the roll R2 of the recording medium P for which take-up has already been concluded can be readily taken out from the recording device 1.

Figure 6:
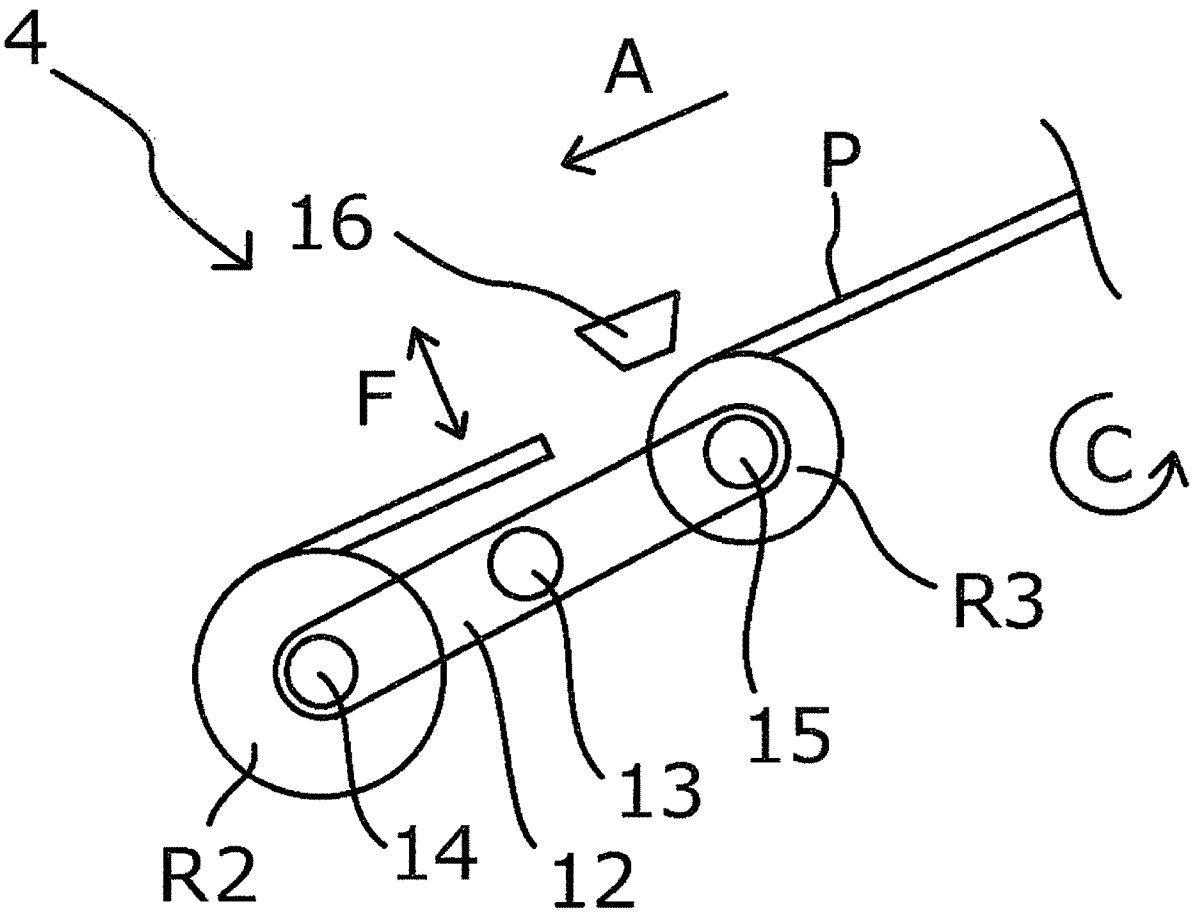
FIG. 6 is a schematic view representing a state after a cutting where the recording medium of the turret of the recording device as in the embodiment 1 of the invention is cut.

The position of the cutter 16 of the recording device 1 of the present embodiment will be described next, as will the operation for cutting the recording medium P by the cutter 16. FIG. 5 is a schematic view representing the state before the cutting at the time when the recording medium P is being cut, and FIG. 6 is a schematic view representing the state after the cutting. As is represented in FIGS. 5 and 6, the cutter 16 is provided to a cutting position at which the recording medium P can be cut in a state where, when the take-up spindle 14 that is being used to take up the recording medium P is being replaced with the other take-up spindle 15, that other take-up spindle 15 is at the take-up position. The cutter 16 cuts the recording medium P by moving in a direction F.

The configuration of such description makes it possible with the recording device 1 of the present embodiment to: mount a paper core for take-up onto the take-up spindle 15, different from the take-up spindle 14 that has previously been used to take up the recording medium P, immediately after the recording medium P has been cut; bond a leading end of the conveyed recording medium P onto the paper core; and thus form a new roll R3 for the recording medium P to be taken up.

Figure 7:
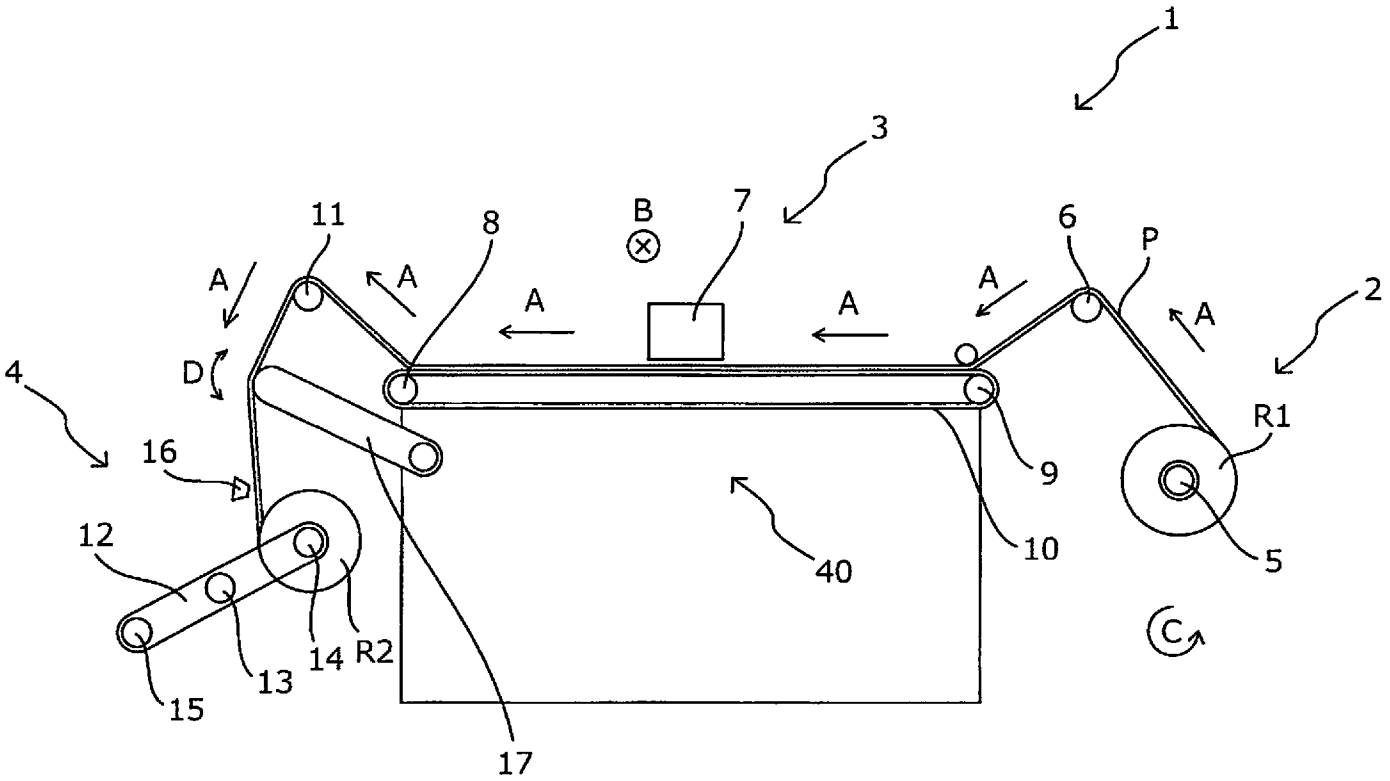
FIG. 7 is a schematic side view representing a recording device as in an embodiment 2 of the invention.

[Embodiment 2] (FIG. 7)

A recording device as in an embodiment 2 of the invention shall be described next. FIG. 7 represents a schematic perspective view of the recording device 1 as in the embodiment 2 of the invention. Constituent members that are in common with the embodiment described above have been assigned like reference numerals, and a detailed description thereof is omitted herein.

The recording device 1 of the present embodiment differs from the recording device 1 of the embodiment 1 in being provided with a tension adjustment lever 17, which is a tension adjustment mechanism for adjusting the tension of the recording medium P applied to the conveyance mechanism 40 (the glue belt 10) from the take-up spindles 14, 15 when the recording medium P is being taken up by the take-up spindles 14, 15. The tension adjustment lever 17 is configured so as to be able to swing in a direction D, and this swinging adjusts the tension of the recording medium P applied to the glue belt 10 from the take-up spindles 14, 15. Because the recording device 1 of the present embodiment is provided with the tension adjustment lever 17, it is possible to minimize any vibration of the recording medium P even in a case where a deviation has arisen in the synchronization of the movement of the recording medium P between the region for recording by the recording head 7 and the take-up spindles 14, 15, thus also making possible to minimize any decline in the image quality of the recorded image.

Figure 8:
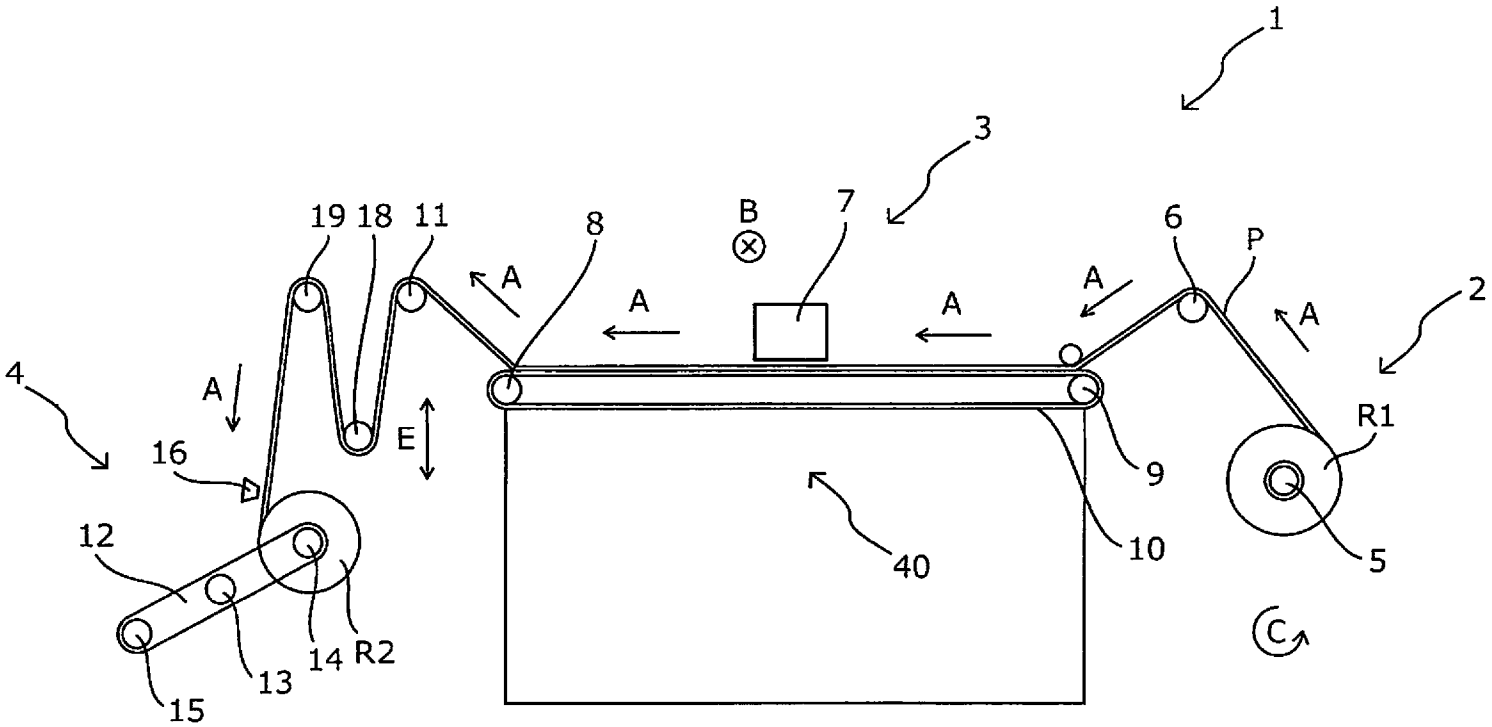
FIG. 8 is a schematic side view representing a recording device as in an embodiment 3 of the invention.

[Embodiment 3] (FIG. 8)

A recording device as in an embodiment 3 of the invention shall be described next. FIG. 8 represents a schematic perspective view of the recording device 1 as in the embodiment 3 of the invention. Constituent members that are in common with the embodiments described above have been assigned like reference numerals, and a detailed description thereof is omitted herein.

The recording device 1 of the present embodiment differs from the recording device 1 of the embodiment 1 and the recording device 1 of the embodiment 2 in that a tension adjustment weight 18, which is a tension adjustment mechanism for adjusting the tension of the recording medium P applied to the glue belt from the take-up spindles 14, 15 when the recording medium P is being taken up by the take-up spindles 14, 15, is provided between the driven roller 11 and a driven roller 19. The tension adjustment weight 18 is configured so as to be able to move in a direction E in association with the movement of the recording medium P, and this movement adjusts the tension of the recording medium P that is applied to the glue belt 10 from the take-up spindles 14, 15. Because the recording device 1 of the present embodiment is provided with the tension adjustment weight 18, it is possible to minimize any vibration of the recording medium P even in a case where a deviation has arisen in the synchronization of the movement of the recording medium P between the region for recording by the recording head 7 and the take-up spindles 14, 15, thus also making possible to minimize any decline in the image quality of the recorded image.

The roll R1 of the recording medium P has been described in the embodiments above as being wound up therearound, but there is no limitation thereto, and there can also be modes such as where the roll R1 is folded up, or is supplied directly to the recording device 1. The recording medium P is not limited to being a recording medium onto which information is printed, but rather can be a medium onto which information or an image is printed, such as transfer paper or fabric used in printing, or plastic media used in signs, advertising, labels, and the like.

Figure 10:
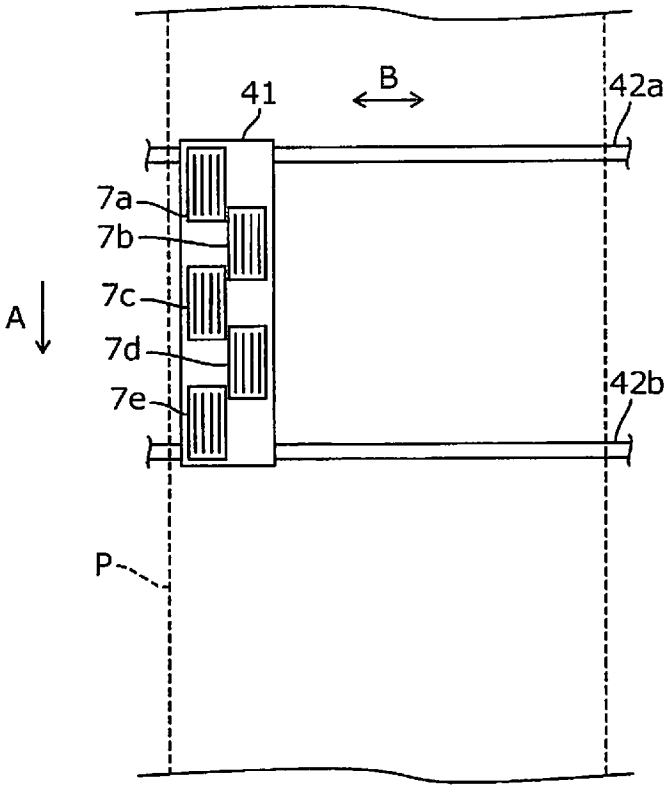
FIG. 10 is a schematic bottom view representing a recording device as in an embodiment 4 of the invention.

[Embodiment 4] (FIG. 10)

Figure 9:
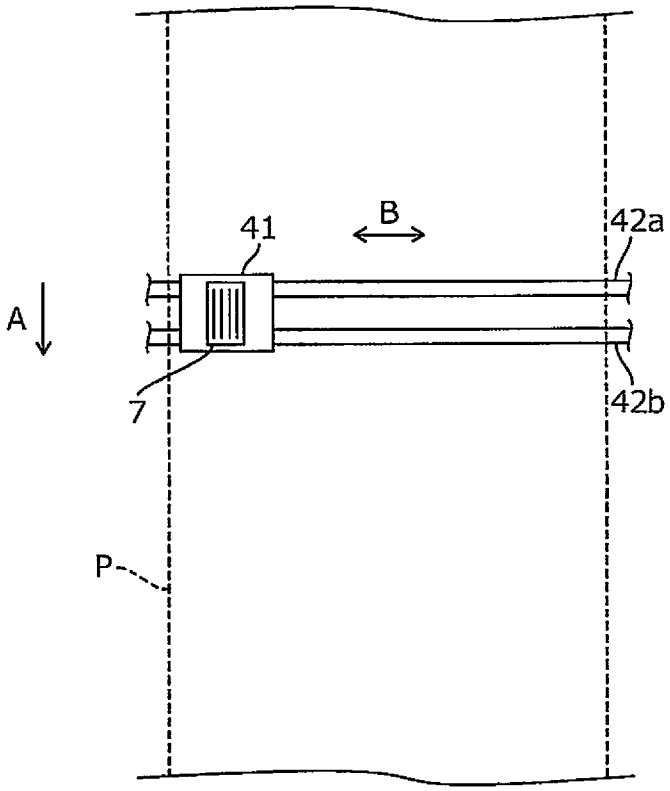
FIG. 9 is a schematic bottom view representing the recording device as in the embodiment 1 of the invention.

A recording device as in an embodiment 4 of the invention shall be described next. FIG. 9 represents a schematic bottom view of the recording device 1 of the embodiment 1 serving as a comparison for describing the embodiment 4 of the invention. FIG. 10 represents a schematic bottom view of the recording device 1 as in the embodiment 4 of the invention. Constituent members that are in common with the embodiments described above have been assigned like reference numerals, and a detailed description thereof is omitted herein. FIGS. 9 and 10 represent the recording medium P with dashed lines so as to facilitate understanding of the positional relationships between each of the constituent members of the recording device 1 in relation to the recording medium P.

As is represented in FIG. 9, in the recording device 1 of the embodiment 1, the carriage 41 onto which the one recording head (head unit) 7 has been loaded moves reciprocatingly along carriage shafts 42*a*, 42*b* in the direction B that intersects with the direction of conveyance A. In the recording device 1 of the embodiment 4, however, the carriage 41 is a multi-head on which a plurality of recording heads (head units) 7*a* to 7*e* are arranged side by side along the direction of conveyance A, and moves reciprocatingly along the carriage shafts 42*a*, 42*b* in the direction B that intersects with the direction of conveyance A. Herein, "along the direction of conveyance A" has a sense that also includes directions somewhat offset from the direction of conveyance A. For this reason, the range of recording that is possible with a single reciprocating scan of the recording heads is broader with the recording device 1 of the present embodiment 4 than the recording device 1 of the embodiment 1, thus improving the recording speed. Having the recording device 1 of the present embodiment 4 be one with a multi-head also increases the length of recording heads in the direction of conveyance A. However, rather than a multi-head, a recording head that has a nozzle column with length in the direction of conveyance A can also be used.

Figure 11B:
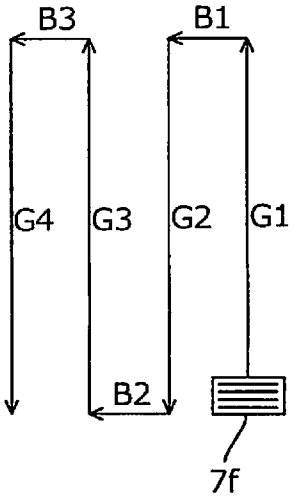
FIGS. 11A and 11B are schematic bottom views representing a recording device as in an embodiment 5 of the invention.
Figure 11A:
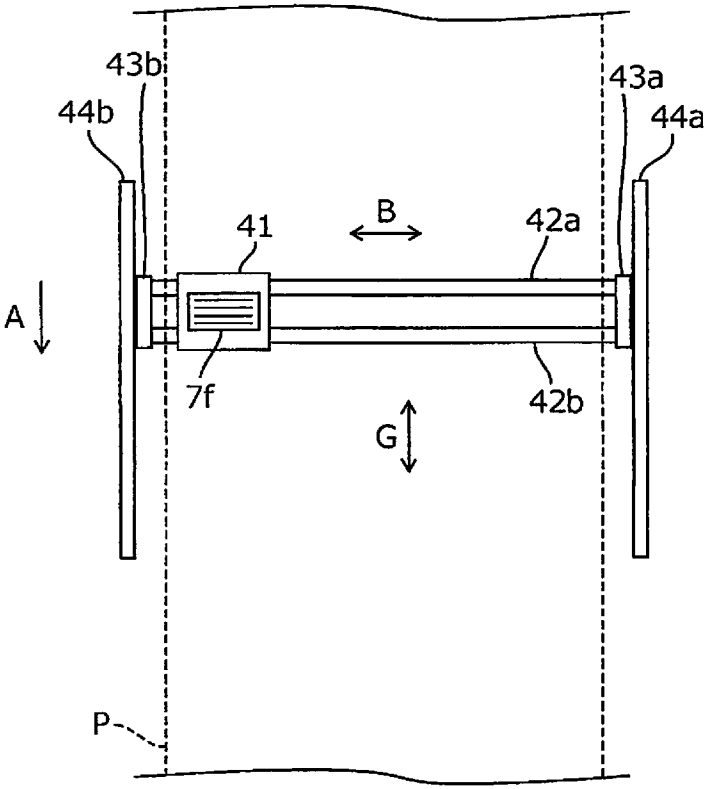

[Embodiment 5] (FIGS. 11A and 11B)

A recording device as in an embodiment 5 of the invention shall be described next. FIG. 11A represents a schematic bottom view of the recording device 1 as in the embodiment 5 of the invention. FIG. 11B represents the direction of movement of a recording head 7*f* for when recording is being carried out in the recording device 1 of the embodiment 5. Constituent members that are in common with the embodiments described above have been assigned like reference numerals, and a detailed description thereof is omitted herein. FIG. 11A represents the recording medium P with dashed lines so as to facilitate understanding of the positional relationships between each of the constituent members of the recording device 1 in relation to the recording medium P.

As is represented in FIG. 11A, the recording device 1 of the present embodiment 5 is provided with carriage bearings 43*a*, 43*b*, which are able to move in a direction G running along the direction of conveyance A in relation to anchor shafts 44*a*, 44*b* provided along the direction of conveyance A. The carriage shafts 42*a*, 42*b* are anchored to the carriage bearings 43*a*, 43*b*, and the carriage 41, onto which a recording head 7*f* is loaded, moves reciprocatingly along the carriage shafts 42*a*, 42*b* in the direction B that intersects with the direction of conveyance A. Then, when recording is being carried out in the recording device 1 of the present embodiment 5, movement of the carriage bearings 43*a*, 43*b* in the direction G in relation to the anchor shafts 44*a*, 44*b* and movement of the carriage 41 in the direction B along the carriage shafts 42*a*, 42*b* causes the recording head 7*f* to move in the directions represented in FIG. 11B. More specifically, first is movement in a direction G1 running along the direction of conveyance A, then movement in a direction B1 that intersects with the direction of conveyance A, then movement in a direction G2 that is inverse to the direction G1, then movement in a direction B2 that is the same as the direction B1, then movement in a direction G3 that is the same as the direction G1, then movement in a direction B3 that is the same as the direction B1, and then movement in a direction G4 that is the same as the direction G2. That is to say, the recording device 1 of the present embodiment is a recording device of a so-called lateral scanning format, in which the recording head 7*f* is scanned along the direction of conveyance A.

Herein, recording onto the recording medium P by the recording head 7*f* is carried out when the carriage bearings 43*a*, 43*b* move in the direction G (move in the directions G1, G2, G3, and G4) in relation to the anchor shafts 44*a*, 44*b*. During movement in the direction B (movement in the directions B1, B2, and B3), however, the driving of the recording head 7*f* is discontinued. The intermittent conveyance of the recording medium P is also discontinued during the series of movements of the recording head 7*f* represented in FIG. 11B (from after the movement in the direction G1 is started, until when the movement in the direction G4 is concluded), corresponding to the recording of the recording region associated with one instance of intermittent conveyance. In the recording device 1 of the present embodiment, after the conclusion of the series of movements of the recording head 7*f* represented in FIG. 11B, then the recording medium P is conveyed by a predetermined amount corresponding to the recording region associated with one instance of intermittent conveyance. That is to say, the recording device 1 of the present embodiment intermittently conveys the recording medium P by repeating a discontinuation of conveyance associated with the recording of the recording region, and the predetermined amount of conveyance following the conclusion of the recording of the recording region.

The configurations of the conveyance mechanism 40 and the take-up mechanism 4 in the recording device 1 of the present embodiment 5 are similar to the configurations of the conveyance mechanism 40 and the take-up mechanism 4 in the recording device 1 of the embodiment 1. Because of these, when the description above is expressed differently, the recording device 1 of the present embodiment 5 is provided with the conveyance mechanism 40 by which the recording medium P can be intermittently conveyed, and the recording mechanism 3 for recording by scanning the recording head 7*f* along the direction of conveyance A of the recording medium P by the conveyance mechanism 40. The recording device 1 is also provided with: the turret 12 to which the plurality of take-up spindles 14, 15 for taking up the recording medium P are provided; the rotational mechanisms 30, 31 of the take-up spindles 14, 15; and the rotational mechanism 29 of the turret 12. The recording device 1 is further provided with the control unit 20 for controlling the rotational mechanisms 30, 31 of the take-up spindles 14, 15 and the rotational mechanism 29 of the turret 12 so as to cause the take-up spindles 14, 15 and/or the turret 12 to intermittently rotate so as to correspond to the intermittent conveyance by the conveyance mechanism 40. The configuration of such description allows the recording device 1 of the present embodiment 5 to address the movement of the recording medium P at the region of recording by the recording head 7*f* and the section of take-up. For this reason, any decline in the image quality of the recorded image is minimized.

The recording head 7*f* in the recording device 1 of the present embodiment 5 is shorter than the width of the width of the recording medium P in the direction B that intersects with the direction of conveyance A, and therefore moves not only in the direction G but also the direction B, as represented by FIG. 11B, when recording the recording region associated with one instance of intermittent conveyance. That is to say, the recording device 1 of the present embodiment 5 is a configuration in which the recording of the recording region associated with one instance of intermittent conveyance is recorded by scanning in a total of four directions G, being the directions G1, G2, G3, and G4, while the recording head 7*f* is also being moved in the direction B. However, there is no limitation to the configuration of such description, and the recording device can also be one that is provided with a so-called line head to which a plurality of nozzle heads for ejecting ink are provided in the direction B that intersects with the direction of conveyance A. According to the configuration provided with such a line head, it becomes possible for the recording of the recording region associated with one instance of intermittent recording to be recorded with one instance of scanning in the direction G, without having to move the line head in the direction B. Herein, a "line head" refers to a recording head which is provided so that a region of nozzles formed in the direction B that intersects with the direction of conveyance A of the recording medium P is able to cover the entirety of the recording medium P in the direction B, and which is used in a recording device for forming an image by fixing either one of the recording head or the recording medium P and moving the other of the two. The region of nozzles in the direction B of the line head need not be able to cover the entirety of all recording media P with which the recording device is compatible in the direction B.

Figure 12:
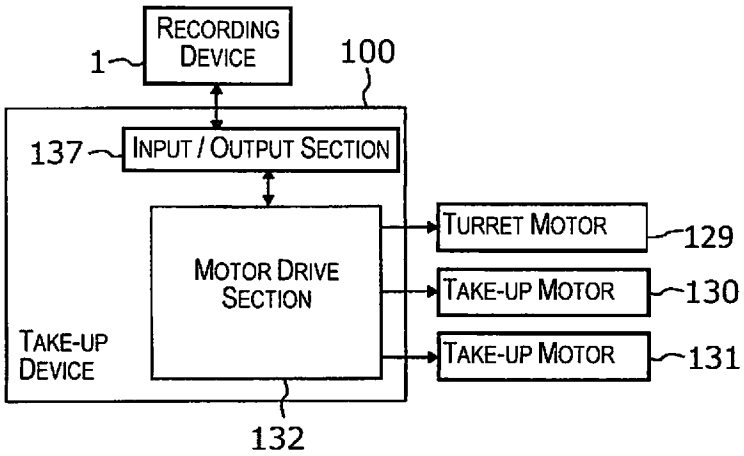
FIG. 12 is a block diagram of a take-up device as in an embodiment 6 of the invention.

[Embodiment 6] (FIG. 12)

A take-up device as in an embodiment 6 of the invention shall be described next. FIG. 12 represents a block diagram of a take-up device 100 as in the embodiment 6 of the invention. The take-up device 100 of the present embodiment 6 has a similar configuration to that of the take-up mechanism 4 of the recording device 1 of the embodiment 1 represented in FIG. 1, other than not having the cutter 16 and the cutter drive section 33. That is to say, the take-up device is provided with the turret 12 to which the plurality of take-up spindles 14, 15 for taking up the recording medium P are provided, and can be used in a recording device provided with a conveyance mechanism by which the recording medium P can be intermittently conveyed. The recording device 1 in which the take-up device 100 of the present embodiment 6 is used is of a similar configuration to that of the recording device 1 of embodiment 1, except in not having the take-up mechanism 4.

The take-up device 100 of the present embodiment 6 is used in the recording device 1 provided with the conveyance mechanism 40 by which the recording medium P can be conveyed intermittently, and is connected to the recording device 1 via an input/output section 137. As stated above, the take-up device 100 is provided with the turret 12 to which the plurality of take-up spindles for taking up the recording medium P are provided. The take-up device is also provided with: take-up motors 130, 131, which are rotational mechanisms of the take-up spindles 14, 15; and a turret motor 129, which is a rotational mechanism of the turret 12, as is represented in FIG. 12. Herein, the take-up motors 130, 131 and the turret motor 129 are connected to a motor drive section 132, connected to the recording device 1 over the input/output section 137. The take-up device 100 of the present embodiment 6 addresses the aforementioned intermittent conveyance by the conveyance mechanism 40, and causes the take-up spindles 14, 15 and/or the turret 12 to rotate intermittently. That is to say, use in the recording device 1 provided with the conveyance mechanism 40 by which the recording medium P can be intermittently conveyed makes it possible to address movement of the recording medium P in the region of recording by the recording head 7 of the recording device 1 and in the take-up device 100 of the present embodiment. For this reason, any decline in the image quality of the recorded image can be minimized.

Figure 13:
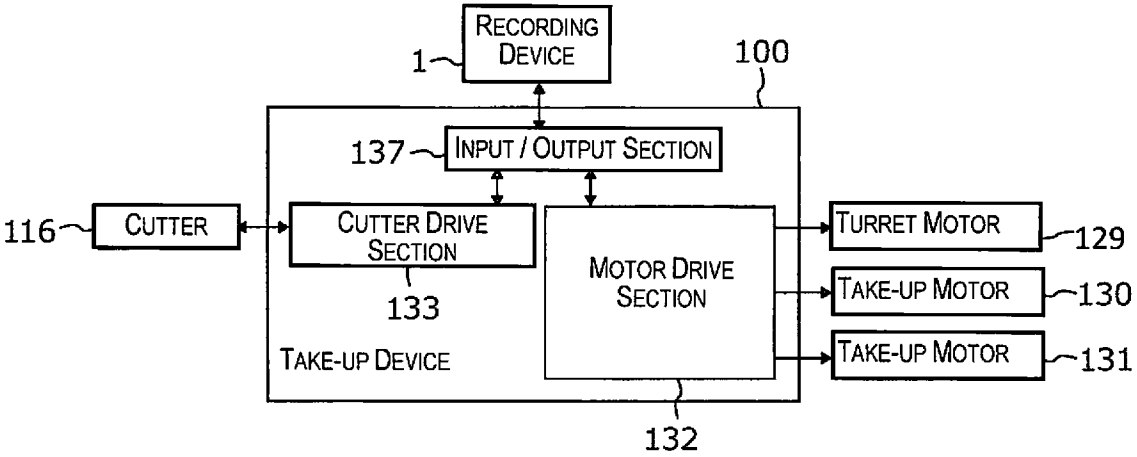
FIG. 13 is a block diagram of a take-up device as in an embodiment 7 of the invention.

[Embodiment 7] (FIG. 13)

A take-up device as in an embodiment 7 of the invention shall be described next. FIG. 13 represents a block diagram of the take-up device 100 as in the embodiment 7 of the invention. The take-up device 100 of the present embodiment 7 is of a similar configuration to that of the take-up device 100 of the embodiment 6, except in having a cutter 116 and a cutter drive section 133. That is to say, the configuration is similar to that of the take-up mechanism 4 of the recording device 1 of the embodiment 1 represented in FIG. 1.

The take-up device 100 of the present embodiment 7 is provided with the cutter 116 serving as the cutting section for cutting the recording medium P, and the cutter drive section 133, which is a drive section of the cutter 116. For this reason, the recording medium P can be automatically cut at a desired position on the basis of cutting information for the recording medium P inputted to the recording device 1 or the like.

A recording device in a first aspect of the embodiment for solving the problem is characterized by being provided with: a conveyance mechanism by which a recording medium can be conveyed intermittently; a recording mechanism for recording by reciprocatingly scanning a recording head in a direction that intersects with a direction of conveyance of the recording medium by the conveyance mechanism; a turret to which a plurality of take-up spindles for taking up the recording medium are provided; rotational mechanisms of the take-up spindles; a rotational mechanism of the turret; and a control unit for controlling the rotational mechanisms of the take-up spindles and the rotational mechanism of the turret so as to cause the take-up spindles and/or the turret to be rotated intermittently so as to correspond to the intermittent conveyance by the conveyance mechanism.

According to the present aspect, the embodiment provides a recording device for recording by reciprocatingly scanning a recording head in a direction that intersects with the direction of conveyance, wherein the recording medium is conveyed intermittently and also the take-up spindles and/or the turret are caused to rotate intermittently so as to correspond to the reciprocating scanning of the recording head. That is to say, movement of the recording medium can be addressed in the region of recording by the recording head and the section of take-up. For this reason, any decline in image quality of the recorded image can be minimized.

A recording device of a second aspect of the embodiment is the first aspect characterized in that the conveyance mechanism includes a glue belt on which the recording medium is placed and a movement mechanism of the glue belt, and the control unit controls the movement mechanism so as to cause the glue belt to be moved intermittently so as to correspond to the reciprocating scanning of the recording head.

In a recording device where the conveyance mechanism includes a glue belt (a belt that is coated with an adhesive by which the recording medium is detachably adhered to and retained by a placement surface for the recording medium), the recording medium can be stably supported, and therefore a glue belt can be preferably used in a recording device for conveying a roll of recording medium. In a recording device having a glue belt, however, the force of peeling the recording medium off of the glue belt causes the recording medium to vibrate considerably when the movement of the recording medium in the region of recording by the recording head and the section of take-up is discontinuous. An effort made to avoid this vibration can produce the need to lengthen the distance between the region of recording by the recording head and the position where the recording medium is peeled away from the glue belt, resulting a larger-sized recording device. The adhesive of the glue belt also deteriorates sooner, because the force for peeling the recording medium from the glue belt also increases. According to the present aspect, it is possible to solve the new problems that are caused by the use of such a glue belt, and the ability to stably support the recording medium makes it possible to minimize any decline in the image quality of the recorded image even more effectively than the first aspect described above.

A recording device of a third aspect of the embodiment is the first or second aspect characterized in that the control unit controls the rotational mechanisms of the take-up spindles so as to discontinue the rotation of the take-up spindles when the turret is being intermittently rotated.

According to the present aspect, the control unit implements a control so as to discontinue the rotation of the take-up spindles when the turret is being intermittently rotated. For this reason, the computations for establishing the amounts of rotation of the turret and the take-up spindles and the like are rendered simpler, thereby simplifying the control of the control unit and making it possible to simplify the configuration of the control unit.

A recording device of a fourth aspect of the embodiment is any of the first through third aspects characterized by being provided with a tension adjustment mechanism for adjusting a tension of the recording medium applied to the conveyance mechanism from the take-up spindles when the recording medium is being taken up by the take-up spindles.

According to the present aspect, it becomes possible to adjust the tension of the recording medium applied to the conveyance mechanism from the take-up spindles when the recording medium is being taken up by the take-up spindles. For this reason, any vibration of the recording medium can be minimized, thus making it possible to minimize any decline in the image quality of the recorded image, even in a case where a deviation as arisen in addressing the movement of the recording medium in the region of recording by the recording head and the section of take-up.

A recording device of a fifth aspect of the embodiment is any of the first through fourth aspects characterized in that a take-up position of the recording medium in a take-up spindle that is being used when the recording medium is being taken up by the take-up spindles is further on the upstream side in the direction of conveyance than that of the other take-up spindle(s).

According to the present aspect, the take-up position of the recording medium in a take-up spindle that is being used when the recording medium is being taken up by the take-up spindles is further on the upstream side in the direction of conveyance than that of the other take-up spindle(s). That is to say, recording medium for which the take-up has already been concluded is positioned further downstream in the direction of conveyance than the take-up spindle that is being used for take-up. For this reason, a roll R2 of the recording medium for which take-up has already been concluded can be readily taken out from the recording device.

A recording device of a sixth aspect of the embodiment is the fifth aspect characterized in that a cutting section for cutting the recording medium is provided to a cutting position at which the recording medium can be cut in a state where, when the take-up spindle that is being used to take up the recording medium is being replaced with another take-up spindle, the other take-up spindle is at the take-up position.

According to the present aspect, it is possible to mount a paper core for take-up or the like onto a take-up spindle different from the take-up spindle that has previously been used to take up the recording medium, immediately after the recording medium has been cut, and set the recording medium so as to be taken up by the paper core or the like.

A recording device of a seventh aspect of the embodiment is any of the first through sixth aspects characterized by being provided with a set section for setting of the recording medium with which rotation of a rotating shaft makes it possible to feed out the recording medium, and a rotational mechanism of the rotating shaft of the set section, the control unit controlling the rotational mechanism of the rotating shaft of the set section so as to cause the rotating shaft of the set section to rotate intermittently so as to correspond to the reciprocating scanning of the recording head.

According to the present aspect, the rotating shaft of the set section is rotated intermittently so as to correspond to the reciprocating scanning of the recording head. For this reason, any vibration of the recording medium can be effectively minimized, thus making it possible to effectively minimize any decline in the image quality of the recorded image.

A recording device of an eighth aspect of the embodiment is any of the first through seventh aspects characterized in that the recording head is a multi-head on which a plurality of head units are arranged side by side along the direction of conveyance.

Herein, "along the direction of conveyance" has a sense that also includes directions somewhat offset from the direction of conveyance. According to the present aspect, the recording head is a multi-head on which a plurality of head units are arranged side by side along the direction of conveyance. For this reason, the range that can be recorded with a single instance of reciprocating scanning of the recording head can be broadened, thus making it possible to improve the recording speed.

A recording device of a ninth aspect of the embodiment is characterized by being provided with: a conveyance mechanism by which a recording medium can be conveyed intermittently; a recording mechanism for recording by scanning a recording head along a direction of conveyance of the recording medium by the conveyance mechanism; a turret to which a plurality of take-up spindles for taking up the recording medium are provided; rotational mechanisms of the take-up spindles; a rotational mechanism of the turret; and a control unit for controlling the rotational mechanisms of the take-up spindles and the rotational mechanism of the turret so as to cause the take-up spindles and/or the turret to be rotated intermittently so as to correspond to the intermittent conveyance by the conveyance mechanism.

According to the present aspect, the embodiment provides a recording device of a so-called lateral scanning format for recording by scanning a recording head along the direction of conveyance, wherein the take-up spindles and/or the turret are caused to rotate intermittently so as to correspond to the intermittent conveyance of the recording medium. That is to say, movement of the recording medium can be addressed in the region of recording by the recording head and the section of take-up. For this reason, any decline in image quality of the recorded image can be minimized.

A take-up device of a tenth aspect of the embodiment is a device for taking up a recording medium used in a recording device provided with a conveyance mechanism by which the recording medium can be intermittently conveyed, wherein the take-up device is characterized by being provided with a turret to which a plurality of take-up spindles for taking up the recording medium are provided, rotational mechanisms of the take-up spindles, and a rotational mechanism of the turret, the take-up spindles and/or the turret being caused to rotate intermittently so as to correspond to the intermittent conveyance by the conveyance mechanism.

According to the present aspect, the embodiment provides a device for taking up a recording medium used in a recording device provided with a conveyance mechanism by which the recording medium can be intermittently conveyed, wherein the take-up spindles and/or the turret are caused to rotate intermittently so as to correspond to the intermittent conveyance of the recording medium. That is to say, use in a recording device provided with a conveyance mechanism by which the recording medium can be conveyed intermittently makes it possible to address movement of the recording medium in a region of recording by the recording head of the recording device and in the take-up device of the present aspect. For this reason, any decline in image quality of the recorded image can be minimized.

A take-up device of an eleventh aspect of the embodiment is the tenth aspect characterized by being provided with a cutting section for cutting the recording medium and a drive section of the cutting section.

According to the present aspect, the take-up device is provided with a cutting section for cutting the recording medium and a drive section of the cutting section. For this reason, it becomes possible to automatically cut the recording medium at a desired position.

A method for taking up a recording medium of a twelfth aspect of the embodiment is carried out using a recording device provided with a conveyance mechanism for conveying a recording medium, a recording mechanism for recording by reciprocatingly scanning a recording head in a direction that intersects with a direction of conveyance of the recording medium by the conveyance mechanism, a turret to which a plurality of take-up spindles for taking up the recording medium are provided, rotational mechanisms of the take-up spindles, and a rotational mechanism of the turret, wherein the method is characterized by including controlling the conveyance mechanism so as to intermittently convey the recording medium, and also controlling the rotational mechanism of the take-up spindles and the rotational mechanism of the turret so as to cause the take-up spindles and/or the turret to rotate intermittently, so as to correspond to the reciprocating scanning of the recording head.

According to the present aspect, it is possible to address movement of the recording medium in the region of recording by the recording head and the section of take-up. For this reason, any decline in the image quality of the recorded image can be minimized.

What is claimed is:

1. A recording device, comprising:

a conveyance mechanism configured to convey a recording medium intermittently in a conveyance direction;

a recording mechanism configured to record by reciprocatingly scanning a recording head in a direction that intersects with the conveyance direction;

a rotational mechanism of a plurality of take-up spindles, which is configured to take up the recording medium; and a control unit configured to control the conveyance mechanism and the rotational mechanism to substantially synchronize conveying of the recording medium by the conveyance mechanism and taking-up of the recording medium by the rotational mechanism to minimize vibration of the recording medium which is being conveyed.

2. The recording device as set forth in claim 1, wherein the control unit is configured to control the recording mechanism to synchronize reciprocatingly scanning of the recording head with the conveying of the recording medium and the taking-up of the recording medium.

3. The recording device as set forth in claim 1, further comprising a feeding-out mechanism configured to feed out the recording medium to the conveyance mechanism, wherein the control unit is configured to control the feeding-out mechanism to synchronize feeding out of the recording medium with the conveying of the recording medium and the taking-up of the recording medium.

4. The recording device as set forth in claim 2, further comprising a feeding-out mechanism configured to feed out the recording medium to the conveyance mechanism, wherein the control unit is configured to control the feeding-out mechanism to synchronize feeding out of the recording medium with the conveying of the recording medium, the taking-up of the recording medium, and the reciprocatingly scanning of the recording head.

5. The recording device as set forth in claim 1, further comprising a turret to which the take-up spindles are rotatably coupled.

* * * * *